US007384346B2

(12) United States Patent
McFarlin et al.

(10) Patent No.: US 7,384,346 B2
(45) **Date of Patent: *Jun. 10, 2008**

(54) GOLF PRACTICE DEVICE

(76) Inventors: James Anthony McFarlin, 204 S. Venice Blvd., Venice, CA (US) 90291; Margaret Tsuey-Hwa McFarlin, 204 S. Venice Blvd., Venice, CA (US) 90291

( * ) Notice: Subject to any disclaimer, the term of this patent is extended or adjusted under 35 U.S.C. 154(b) by 28 days.

This patent is subject to a terminal disclaimer.

(21) Appl. No.: 11/263,210

(22) Filed: Nov. 1, 2005

(65) Prior Publication Data

US 2007/0099717 A1 May 3, 2007

(51) Int. Cl.
*A63B 69/36* (2006.01)

(52) U.S. Cl. ..... 473/278; 473/279

(58) Field of Classification Search ..... 473/150, 473/157, 218, 257, 261–273, 278, 279
See application file for complete search history.

(56) References Cited

U.S. PATENT DOCUMENTS 3,348,847 A * 10/1967 Fischl ..... 473/262
4,130,283 A * 12/1978 Lindquist ..... 473/262
4,311,312 A * 1/1982 O'Brien ..... 473/218
4,387,896 A * 6/1983 O'Brien ..... 473/218
5,692,967 A * 12/1997 Guyer ..... 473/262
6,746,340 B1 * 6/2004 Dover ..... 473/278
6,994,634 B1 * 2/2006 McFarlin et al. ..... 473/278

* cited by examiner

*Primary Examiner*—Nini F. Legesse
(74) *Attorney, Agent, or Firm*—Lawrence S. Cohen

(57) ABSTRACT

A golf practice device is disclosed that simulates the response of natural turf when impacted by the golf club head. The device comprises a platform for supporting the golfer and a divot simulator insert installed in a cavity area within the platform. The divot simulator insert has a base; a tray rests on top of the base with a simulated turf surface fitted therein. A cover is provided to conceal the interior and strengthen the base. When a ball placed on the simulated turf surface is struck by a golf club, the force imparted to the device sends the tray together with the simulated turf surface sliding forward, thus simulating the feel of hitting off natural turf and taking a divot. Means comprising compression springs fitted over guide rails are provided to control the sliding forward and retraction to their original position of the tray and the simulated turf surface.

23 Claims, 9 Drawing Sheets

70
72
73
71
60
53
30
50
52
51
54
53
52
42
45
54
40
44
45
45
46
41
45
44
43
42
41
43

GOLF PRACTICE DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates in general to a golf practice device, and more particularly to a golf practice device that (1) has a platform for supporting the golfer and securing a divot simulator insert installed therein, and (2) the divot simulator insert includes a surface component that yields and moves when impacted by the head of a golf club to simulate the response of natural turf and facilitate the practice and development of a correct golf swing.

2. Prior Art

To be skilled at the techniques of golf requires a golfer to practice regularly beyond the time spent on playing the game on golf courses. Many indoor/outdoor golf practice facilities have been created to accommodate golfers' need to practice, and the use of golf practice mats at these facilities is a common and long-established practice. The conventional golf practice mats are available in a variety of materials and have a surface layer simulating natural grass. These mats generally perform adequately for practicing wood shots off a tee. However, they are deficient for practicing iron shots and may actually impede the development of a correct swing.

A correct iron shot requires the golf club head to impact the golf ball on the downswing momentarily before it reaches the lowest point of the swing arc, i.e., the path of the golf club head during a swing. The descending club head will naturally remove a small patch of turf, known as a divot, below or immediately in front of the ball. Conventional golf practice mats are generally of stiff, unyielding construction and do not allow the action of taking a divot. A correct golf swing practiced on such a mat will actually produce the wrong "feel" as the club head, after hitting the ball, is impeded by and bounces off the mat. Further, to lessen the shock to the wrists and elbows and risk of injury, the golfer may alter his swing to "scoop" or sweep the ball off the mat cleanly instead of hitting "down and through" and thus develop an incorrect way of hitting iron shots. Also, when the golfer makes an incorrect swing and strikes the mat behind the ball, i.e., making a "fat" shot, the shock from hitting a hard and unyielding surface can lead to injuries to elbows and other joints. To make matters worse, the fear of experiencing pain may cause the golfer to tense up and produce more bad shots thus negating the benefit of practice. Lastly, some golf practice mats have a surface layer consisting of long fibers or inverted brushes to help reduce club head bounce and risk of injury. However, these mats may have too much "give" and more closely simulate fringe grass than fairway turf.

Many golf practice devices have been conceived over the years incorporating a hitting surface that yields or moves when struck by the head of a golf club to simulate the response of natural turf; some are designed to be portable so golfers can carry and use them at golf practice facilities. Examples are shown in the following U.S. patents or pending applications.

U.S. Pat. No. 6,156,396 issued to Florian discloses a device consists of a base pad formed of a resilient elastomeric material and an artificial grass carpet positioned on the base pad. When a golf ball on the carpet surface is struck, the carpet slides a limited distance and is then returned by an elastic biasing mechanism.

U.S. Pat. No. 5,897,443 issued to Glaser discloses a device comprises a mat with an insert, which further consists of a continuous belt extending around parallel rollers to create a movable ball supporting surface and a tray holding deformable material placed beneath the belt upper surface. Striking of the belt upper surface depresses the belt downwardly while rotating it toward the front of the mat.

U.S. Pat. No. 5,888,147 issued to Luedtke discloses a device comprises an anchor piece and a divot piece connected by elastic rubber bands.

U.S. Pat. No. 5,692,967 issued to Guyer discloses a device consists of a support frame, a mat and a tray with a set of casters that roll on descending ramps attached to the frame. When a golf ball is hit from the mat, the mat and tray deflect downwardly, the mat slides partially off the tray and the tray rolls down the ramps. The mat and tray return to the original position via a tension spring means.

U.S. Pat. No. 4,928,966 issued to Miller discloses a device comprises a frame, multiple layers disposed in spaced relation to each other on the frame, and a base attachment. The base attachment possesses guide means and rubber band means to control the sliding forward and back of the frame member.

U.S. Pat. No. 4,955,611 issued to Moller discloses a device comprises a mat affixed on top of a bladder filled with gas or liquid and disposed within a base board. The mat and bladder slide forward and optionally downward when struck by a golf club, and are returned by spring means.

U.S. Pat. No. 4,913,442 issued to Walker discloses a device comprises a sliding pad mounted in a U-shaped stance pad. The sliding pad is in tongue and groove relation with the stance pad over short length near its exposed end, the rest being free to propagate a wave ahead of a swinging golf club's head to simulate the feel of taking a divot.

U.S. Pat. No. 4,875,685 issued to Ballinger, et al. discloses an apparatus that includes a platform for the golfer to stand on, a main frame connected to the platform adjacent thereto, and an inner frame covered with artificial turf surface and mounted within the main frame. The inner frame pivots forward and then downward in a generally arcuate path when the surface is impacted by the golf club head. The platform can be folded to form a carrying case in which the components can be stored.

U.S. Pat. No. 4,387,896 issued to O'Brien discloses a device comprises a hitting surface slidably positioned within a frame and supported by a static surface.

U.S. Pat. No. 4,130,283 issued to Lindquist discloses a device with artificial turf secured to a cushioned support that is movable in the direction of the ball flight and compressible when the surface is struck. The movable and compressible portion returns via a spring means.

U.S. Pat. No. 3,712,628 issued to Boss, Jr. discloses a device comprises a rigid housing containing rollers which support an endless belt with simulated grass outer surface. A platform beneath the upper portion of the belt pivots about one end and is held against the inner surface of the belt by an elastic means.

While these devices may accomplish their stated objectives to some extent, they suffer from one or more of the following limitations: (1) being too complex or too expensive to manufacture to be economically viable; (2) employing materials or involving parts that tend to fatigue or break with repeated use; (3) having an excessively high profile and requiring the golfer to stand on an elevated platform; (4) showing visually distracting elements such as rubber bands, cords and gaps on or around the hitting surface; and (5) requiring extraneous means such as spikes to anchor the device to the ground, which is impractical when the ground is hard surface such as concrete.

Co-pending application Ser. No. 11/070,320 by the same inventors of this application discloses a device that is portable and incorporates a base extension which can be slid under a platform for maintaining stability during use. The device comprises a simulated turf surface fitted in a tray slidably positioned on a base. The tray slides forward when struck by a golf club head; means are provided to return it to its original position. The limitation of the device is that it must be disposed adjacent to an extraneous platform.

BRIEF SUMMARY OF THE INVENTION

The present invention relates to a golf practice device having a hitting surface that yields and moves when impacted by the head of a golf club to more accurately simulate what the golfer experiences when hitting a golf ball off natural turf.

The present invention provides a golf practice device comprises a platform for supporting the golfer and a divot simulator insert installed in a cavity area within the platform. The divot simulator insert has a base member and a tray rests on top of the base member with a simulated turf surface fitted therein. A cover is also provided to conceal the interior and strengthen the base member. When a golf ball placed on the simulated turf surface is struck by a golf club, the force imparted to the device sends the tray together with the simulated turf surface sliding forward, thus simulating the feel of hitting off natural turf and taking a divot. Means comprising forward and rearward compression springs fitted over guide rails are provided to control the sliding forward and retraction to their original position of the tray and the simulated turf surface.

Another aspect of the present invention provides a golf practice device that reduces club head bounce and lessens stress on the golfer's wrists and elbows, thus reducing negative reinforcement experienced by the golfer and risk of injury.

A further aspect of the present invention provides a golf practice device with a hitting surface that yields and gives way, thus experiencing less wear from repeatedly struck by a club head carrying tremendous force and, therefore, having longer useful life.

Yet another aspect of the present invention provides a golf practice device that has a simple construct with few components, is strong and durable, and does not employ materials or involve parts that tend to tear, deform, fatigue or break with repeated use.

These and other aspects and advantages of the present invention will become apparent after a reading of the following description and accompanying drawings.

BRIEF DESCRIPTION OF THE SEVERAL VIEWS OF THE DRAWING

It is to be understood that like elements are identified throughout the drawings with like reference numerals.

DETAILED DESCRIPTION OF THE INVENTION

Figure 1:
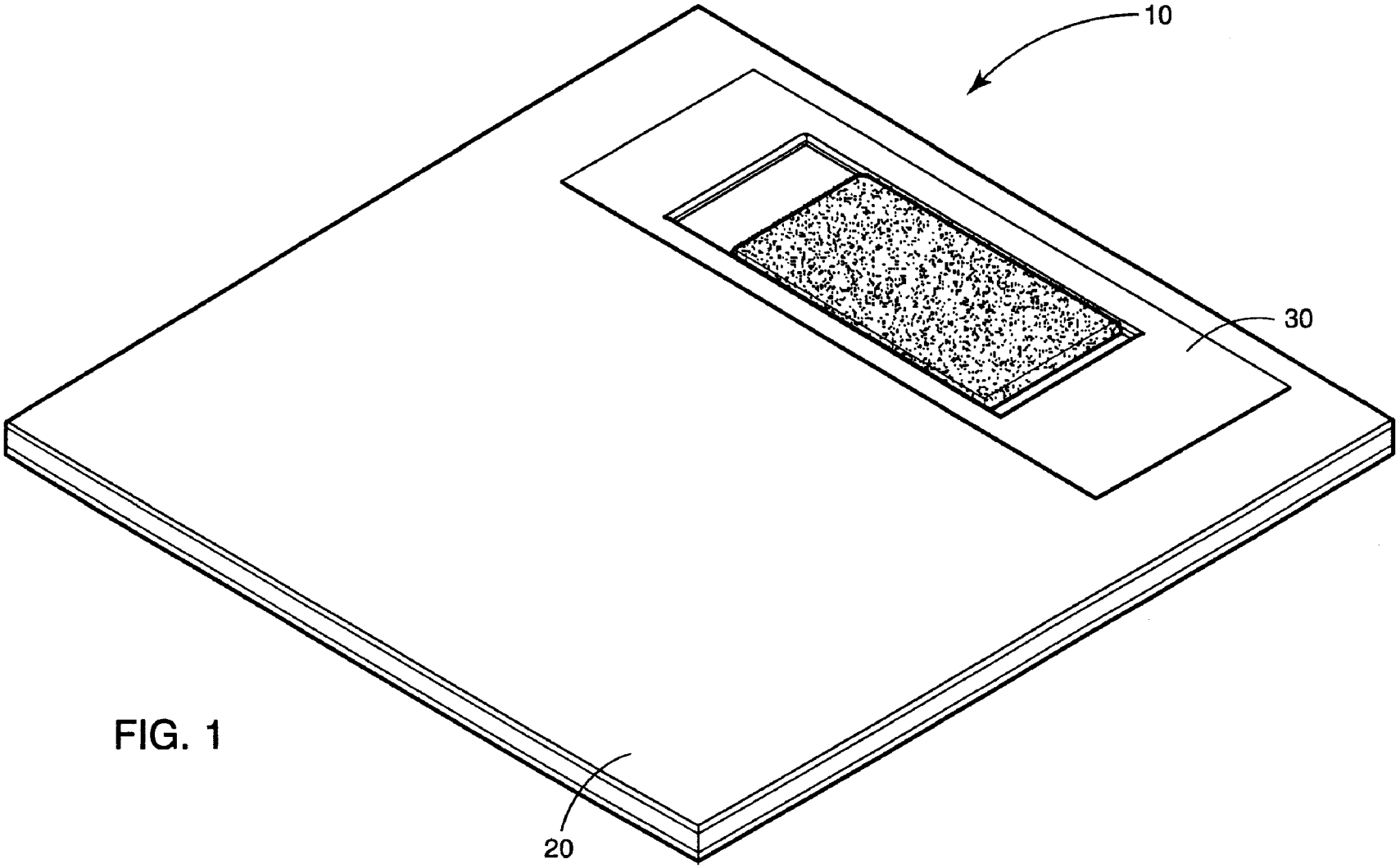
FIG. 1 is a perspective view of the preferred embodiment of the golf practice device constructed in accordance with the present invention.

The golf practice device according to the concepts of the present invention and how it functions can best be explained by reference to the attached drawings. As illustrated in FIGS. 1-11, the preferred embodiment of the golf practice device 10 comprises a platform member 20 and a divot simulator insert 30; the divot simulator insert 30, in turn, consists of a base member 40, a carriage assembly 50, a simulated turf surface 60 and a cover member 70.

Figure 2:
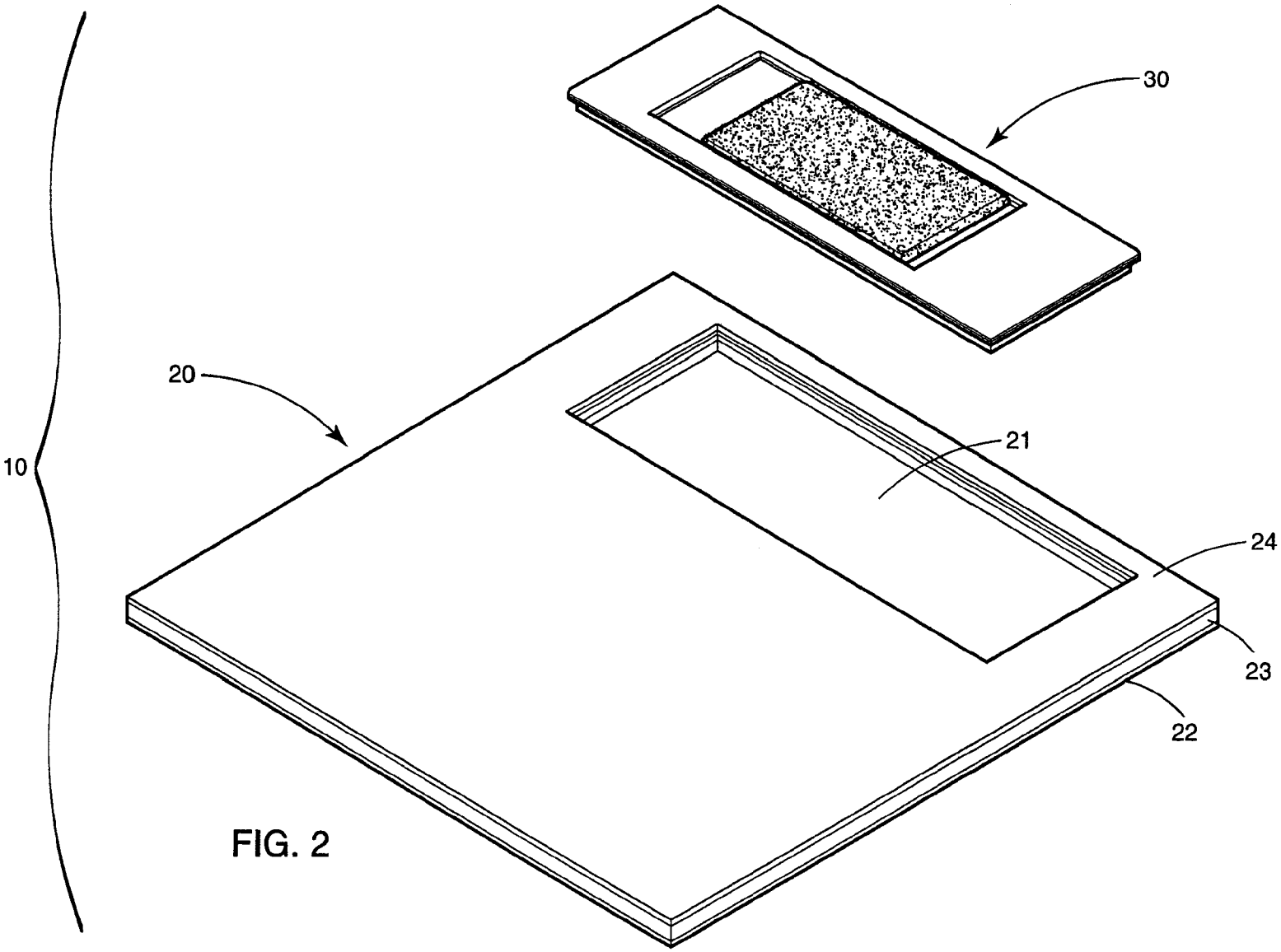
FIG. 2 is an exploded perspective view of the golf practice device shown in FIG. 1 showing separately the platform member and the divot simulator insert.

Referring to FIGS. 1 and 2, the platform member 20 is generally square or rectangular in shape and is substantially similar to many of the commercially available golf practice mats, except for the cavity area 21 that is to receive the divot simulator insert 30. The platform member 20 preferably consists of a base layer 22 made of a sturdy material, a cushioning layer 23 made of a resilient material such as rubber to provide proper support and stability and bonded to the base layer 22 by any conventional means, and a simulated turf layer 24 made of plastic to simulate grass and bonded to the cushioning layer 23 by any conventional means. It is to be understood that any platform composition that provides adequate cushion and has a non-skid surface that allows the golfer to maintain his footing through a golf swing may be used in an embodiment of the device without affecting its functions. A generally rectangular area is cut out through the cushioning layer 23 to create the cavity area 21 wherein the divot simulator insert 30 is installed. The upper portions of the side walls of the cavity area 21 are further recessed to accommodate the cover member 70 that is detailed below with reference to FIGS. 3 and 6.

Figure 3:
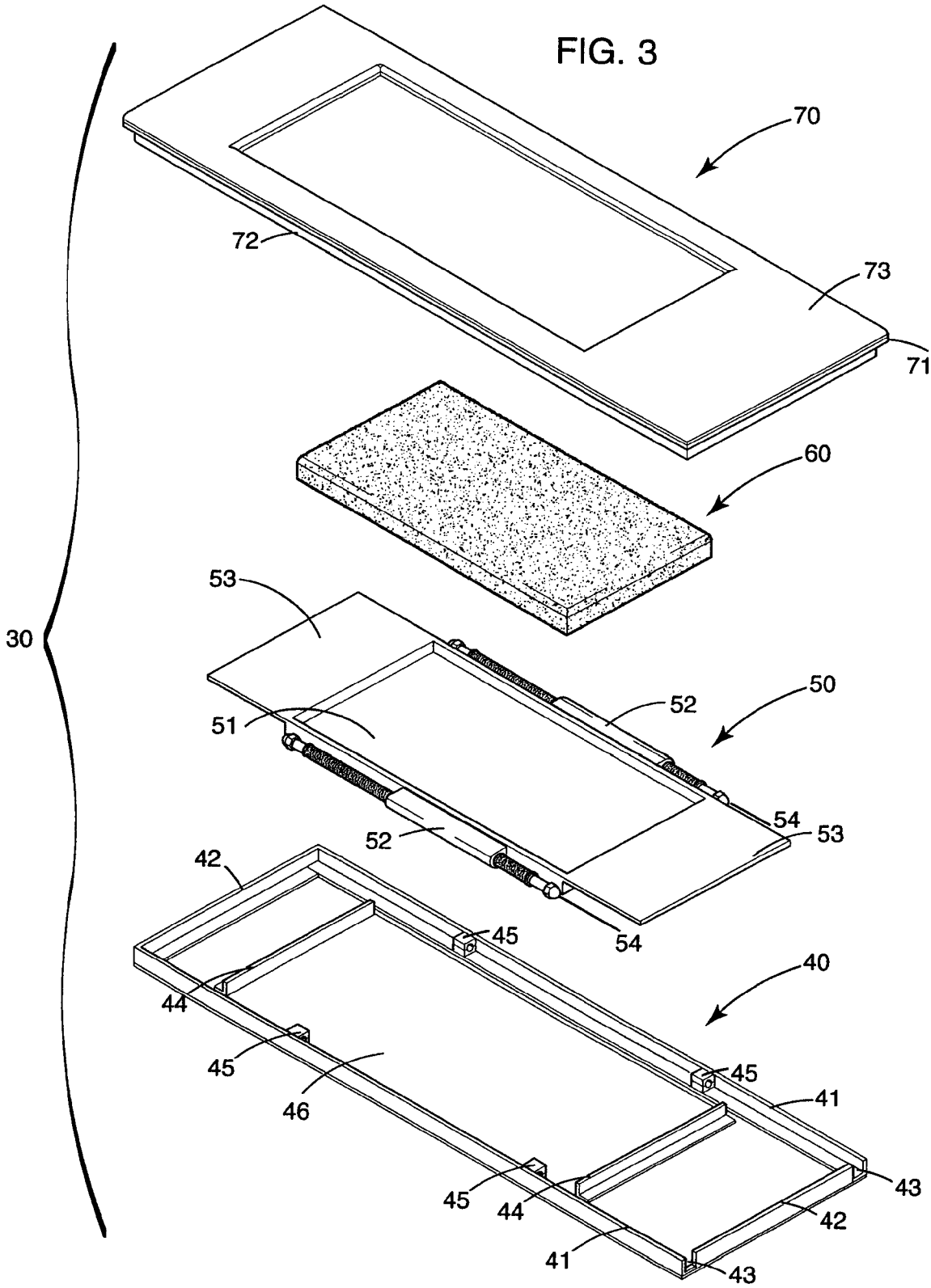
FIG. 3 is an exploded perspective view of the divot simulator insert in accordance with the present invention.

Referring to FIG. 3, the base member 40 is rectangular in shape with its longitudinal axis generally aligned with the direction of the line of flight of the golf ball to be struck from the surface of the golf practice device 10, and has side frames 41 along the length dimension on either side and end frames 42 along the width dimension to increase rigidity. Preferably, one of the end frames 42 has cutouts 43 that coordinate with the dimensions of the carriage retraction means 54 of the carriage assembly 50 that is detailed below. The side and end frames 41, 42 preferably are L-shaped to increase the strength and tautness of the base member 40. The cutouts 43 allow for the disassembly and reassembly of the carriage assembly 50 for cleaning and replacement of parts. Preferably, support means 44 are sited at locations determined by the dimensions of the carriage tray 51 and the carriage extensions 53. They are provided to support the carriage extensions 53 when pressure is exerted thereon and to ensure that the carriage extensions 53 move on a horizontal plane during use. The support means 44 are L-shaped bars in the drawings, though they may assume differing shapes or sizes without affecting their functions. Mounting brackets 45 are affixed to the bottom of the base member 40 and the side frames 41 at positions determined by the length of the carriage retraction means 54, and are provided to mount and hold in place the carriage retraction means 54. On the bottom of the base member 40 between the support means 44 is an anti-friction layer 46 made of a low-friction material such as Teflon®. The base member 40 is preferably made of a metal or metal alloy but can be fabricated with generally any structural material such as metals, metal alloys or plastics, and can be either a single-piece construction or assembled from parts.

Figure 4:
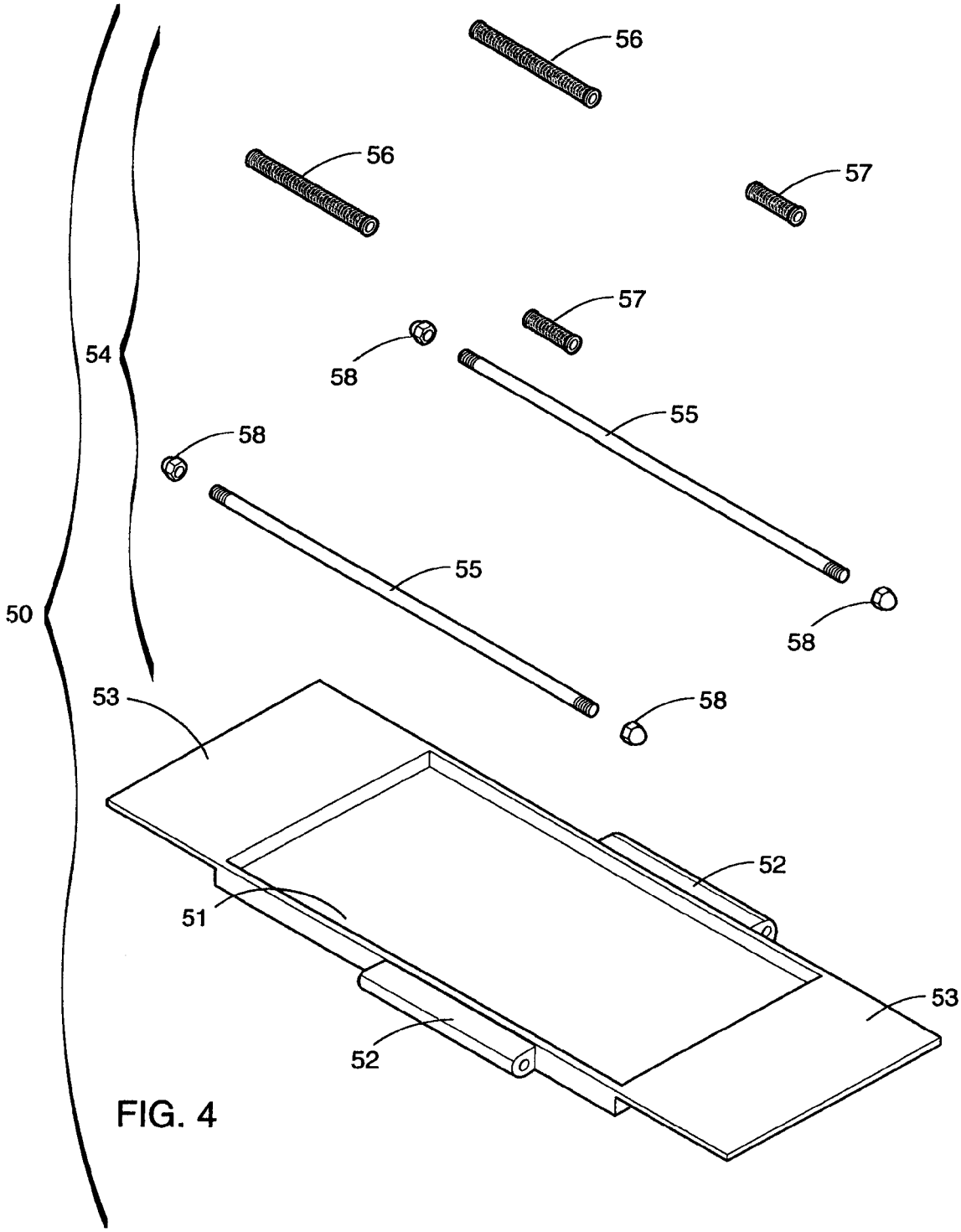
FIG. 4 is an exploded perspective view of the carriage assembly component of the divot simulator insert in accordance with the present invention.
Figure 5:
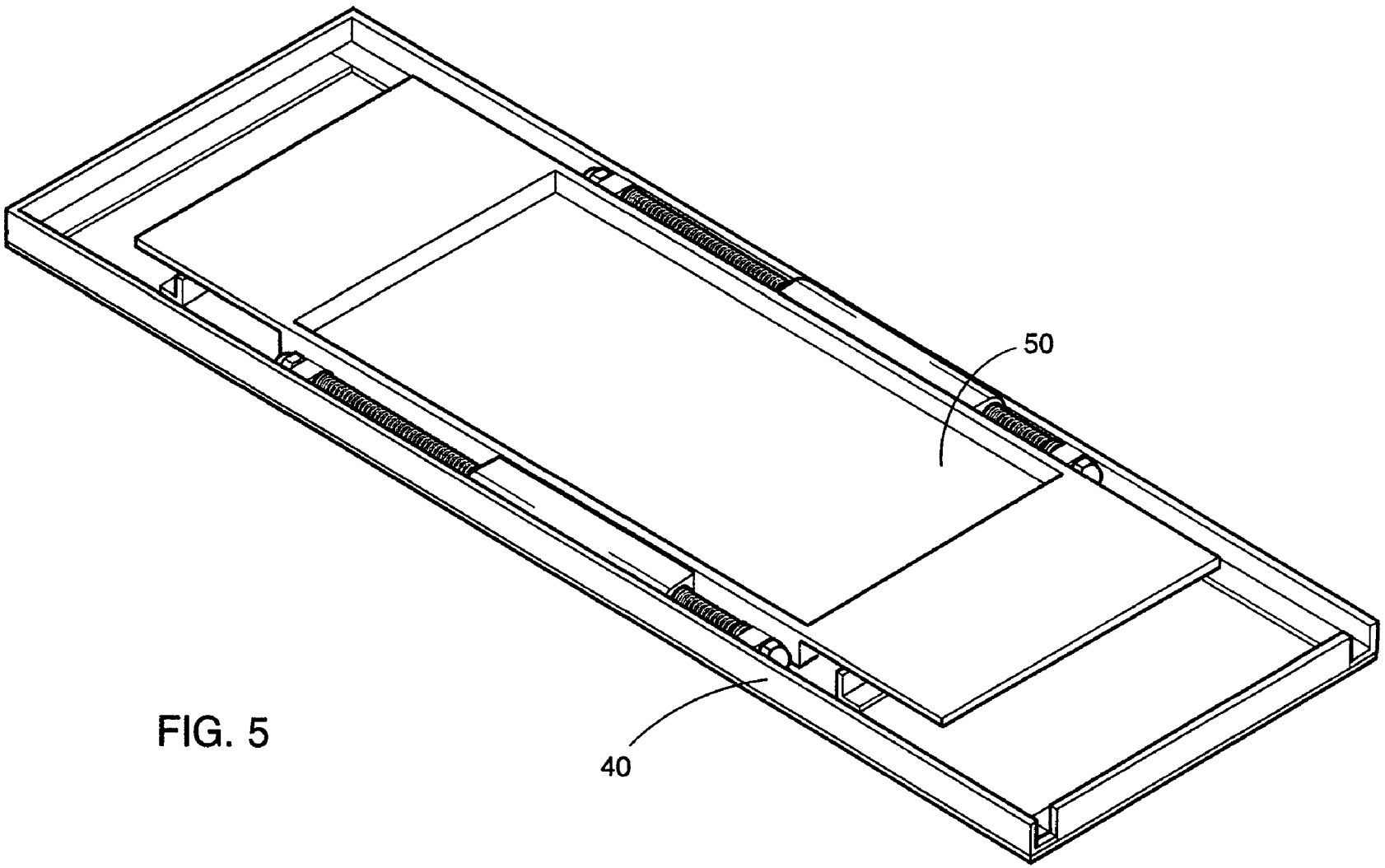
FIG. 5 is a perspective view of the base member and the carriage assembly of the divot simulator insert in accordance with the present invention, showing the carriage assembly mounted on the base member.
Figure 7:
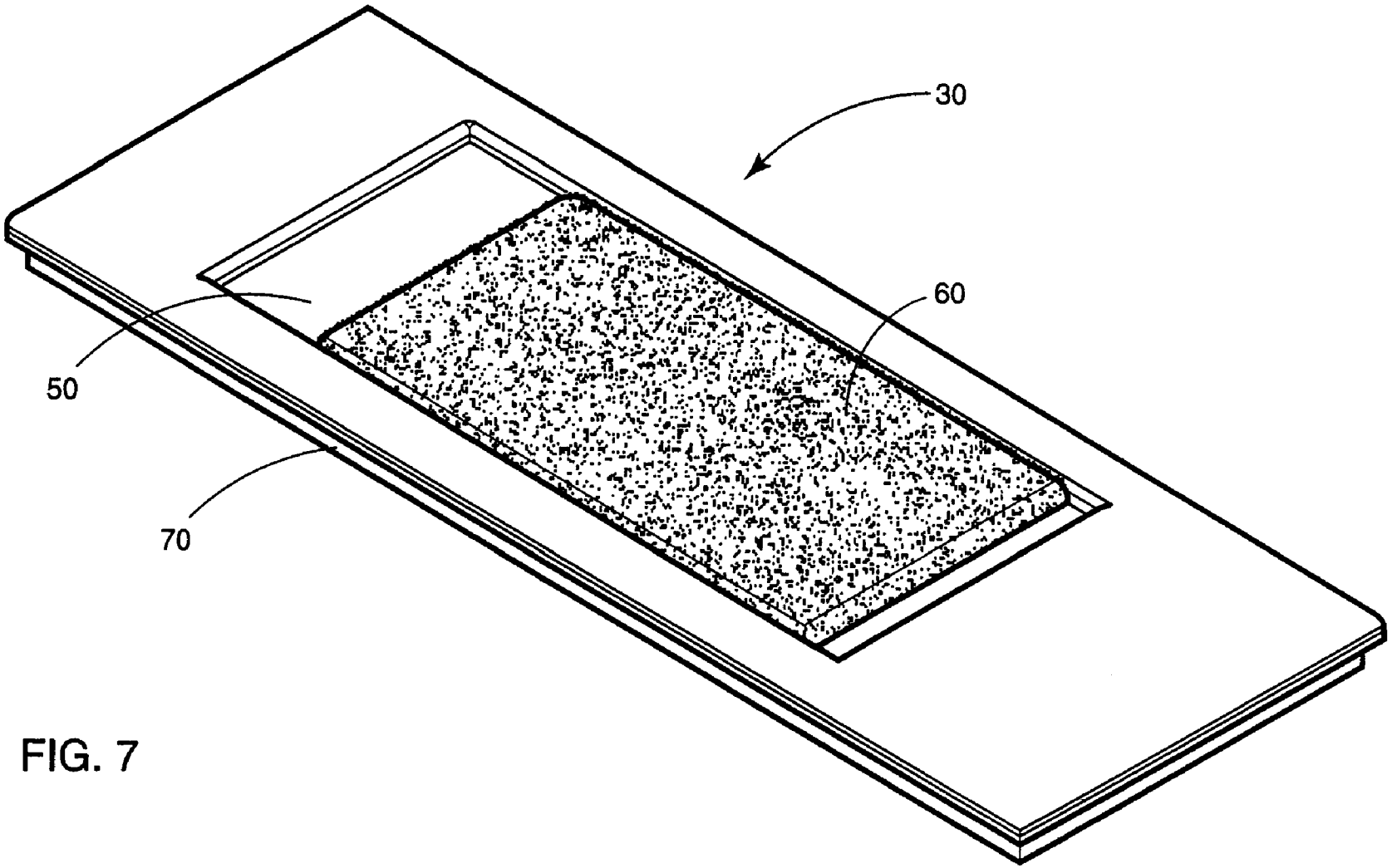
FIG. 7 is a perspective view of the divot simulator insert in accordance with the present invention with the carriage assembly and simulated turf surface in an extended position.
Figure 8:
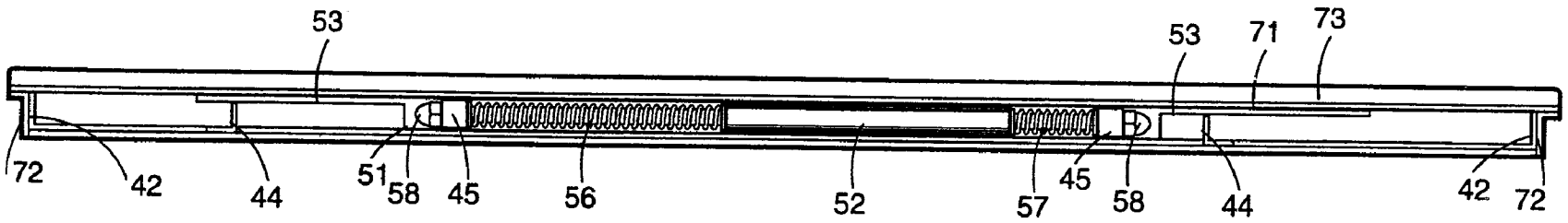
FIG. 8 is a longitudinal, side elevational view of the divot simulator insert in accordance with the present invention without the simulated turf surface, and with the carriage assembly in the at-rest position and the vertical portion of the side frame omitted to show the carriage retraction means. The support means are illustrated in their entirety for clarity, even though portions should be obscured by the horizontal portion of the side frame.
Figure 9:
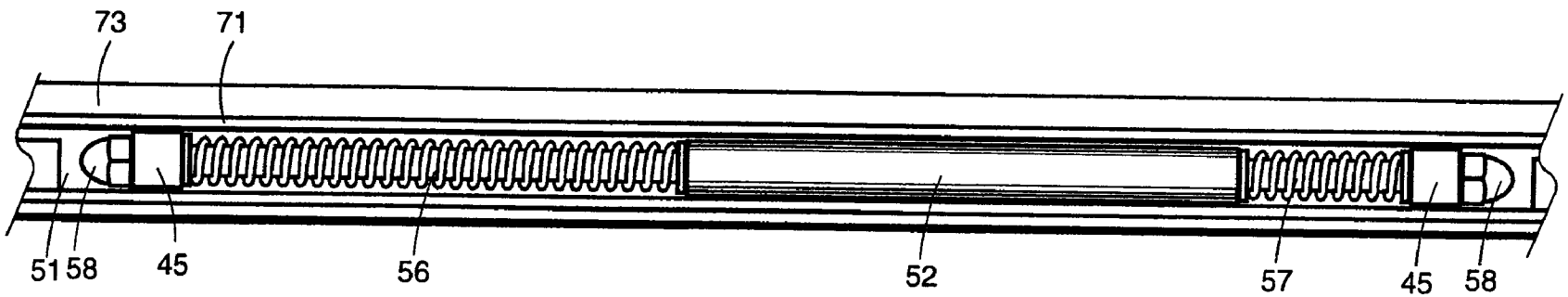
FIG. 9 is a partial, enlarged view of the divot simulator insert as shown in FIG. 8.
Figure 10:
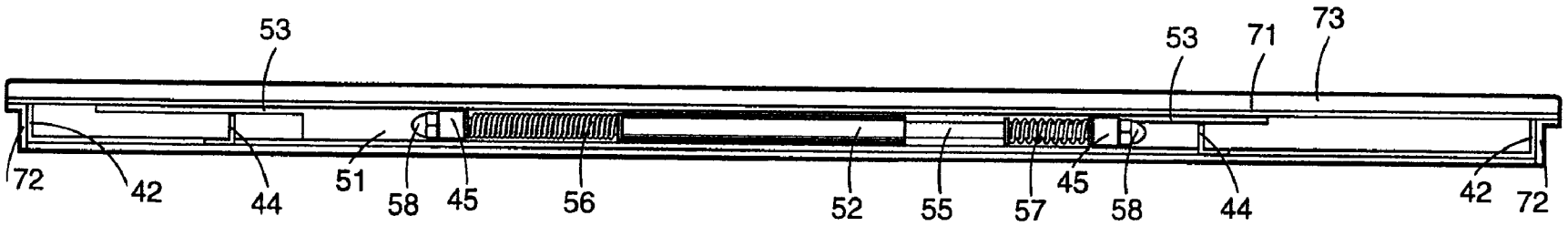
FIG. 10 is a longitudinal, side elevational view of the divot simulator insert in accordance with the present invention without the simulated turf surface, and with the carriage assembly in an extended position and the vertical portion of the side frame omitted to show the carriage retraction means. The support means are illustrated in their entirety for clarity, even though portions should be obscured by the horizontal portion of the side frame.
Figure 11:
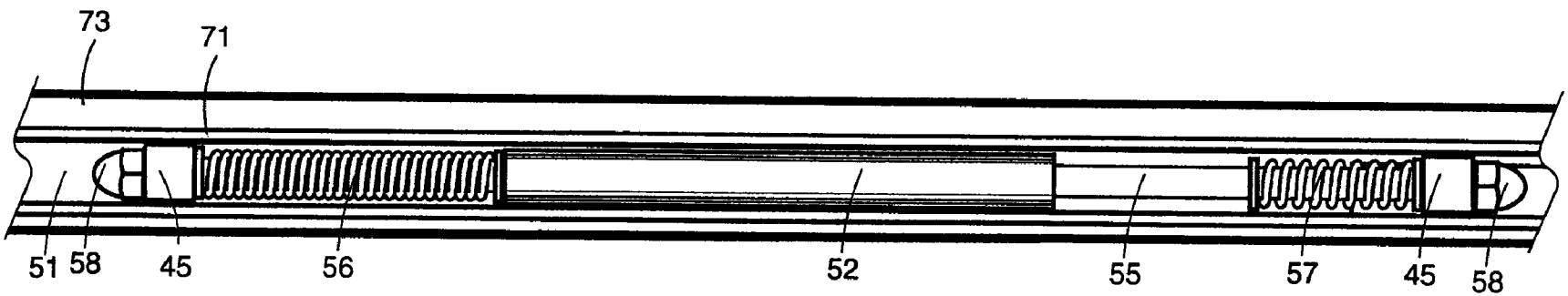
FIG. 11 is a partial, enlarged view of the divot simulator insert as shown in FIG. 10.

As illustrated in FIGS. 3-5, the carriage assembly 50 comprises a generally rectangular carriage tray 51 with sleeves 52 and carriage extensions 53, and dual carriage retraction means 54. Each carriage retraction means 54 further consists of a guide rail 55, one or multiple forward compression springs 56 and a rearward compression spring 57, with the compression springs 56, 57 generally having the same inner and outer diameters as the sleeves 52. The guide rails 55 have thread means at the ends for affixing nuts 58. The sleeves 52 are hollow, generally cylindrical tubes that are affixed to the sides of the carriage tray 51 along the length dimension and positioned toward the aft end. When assembled, the sleeves 52 are fitted over the guide rails 55 and sandwiched between the forward and rearward compression springs 56, 57 such that the movement of the carriage tray 51 is controlled by the carriage retraction means 54. The carriage tray 51 has upstanding edges on all sides. The carriage extensions 53 extend outward from the top of the edges on the forward and the aft sides so that the base member 40 remains obscured when the carriage tray 51 is in an extended position, as shown in FIGS. 7 and 10. The maximum distance that the carriage tray 51 is allowed to travel during use determines the dimensions of the carriage extensions 53.

Referring to FIG. 5, when the golf practice device 10 is assembled, the carriage retraction means 54 are positioned between the mounting brackets 45 with the guide rails 55 mounted on the mounting brackets 45. The nuts 58 are attached to secure the guide rails 55 in place. The carriage tray 51 fits between the support means 44; the carriage extensions 53 are positioned over and supported by the support means 44. The carriage tray 51 sits on the base member 40 when at rest and slides forward and back when in motion. The carriage tray 51, sleeves 52 and carriage extensions 53 are preferably made of thermoplastic and can be either a one-piece construction or assembled from parts. In an alternate embodiment, the carriage tray 51, and optionally the sleeves 52 and carriage extensions 53, and the base member 40 are fabricated with filled and alloyed plastic composites possessing performance qualities such as: improved abrasion-resistance, lower static and dynamic friction, higher compressive strengths and improved creep resistance. When both the base member 40 and the carriage tray 51 are fabricated with such plastic composites, they are to be made of dissimilar polymers to ensure low coefficient of friction and thus may eliminate the need for the anti-friction layer 46.

As illustrated in the drawings, the simulated turf surface 60, which may be made of any of the commercially available artificial turfs that are made of sturdy plastic and used for golf practice mats, is fitted inside the carriage tray 51 and preferably extends slightly above the top plane of the carriage tray 51. The simulated turf surface 60 may be adhesively bonded to the carriage tray 51 or, preferably, removably affixed to the carriage tray 51 with attaching means such as hook-and-loop fasteners. When the simulated turf surface 60 is removably affixed to the carriage tray 51 in an embodiment of the present invention, it can be replaced when worn and different surfaces may be produced to simulate various golf course conditions such as rough fringes and uneven lies for the golfer to practice different shots.

Figure 6:
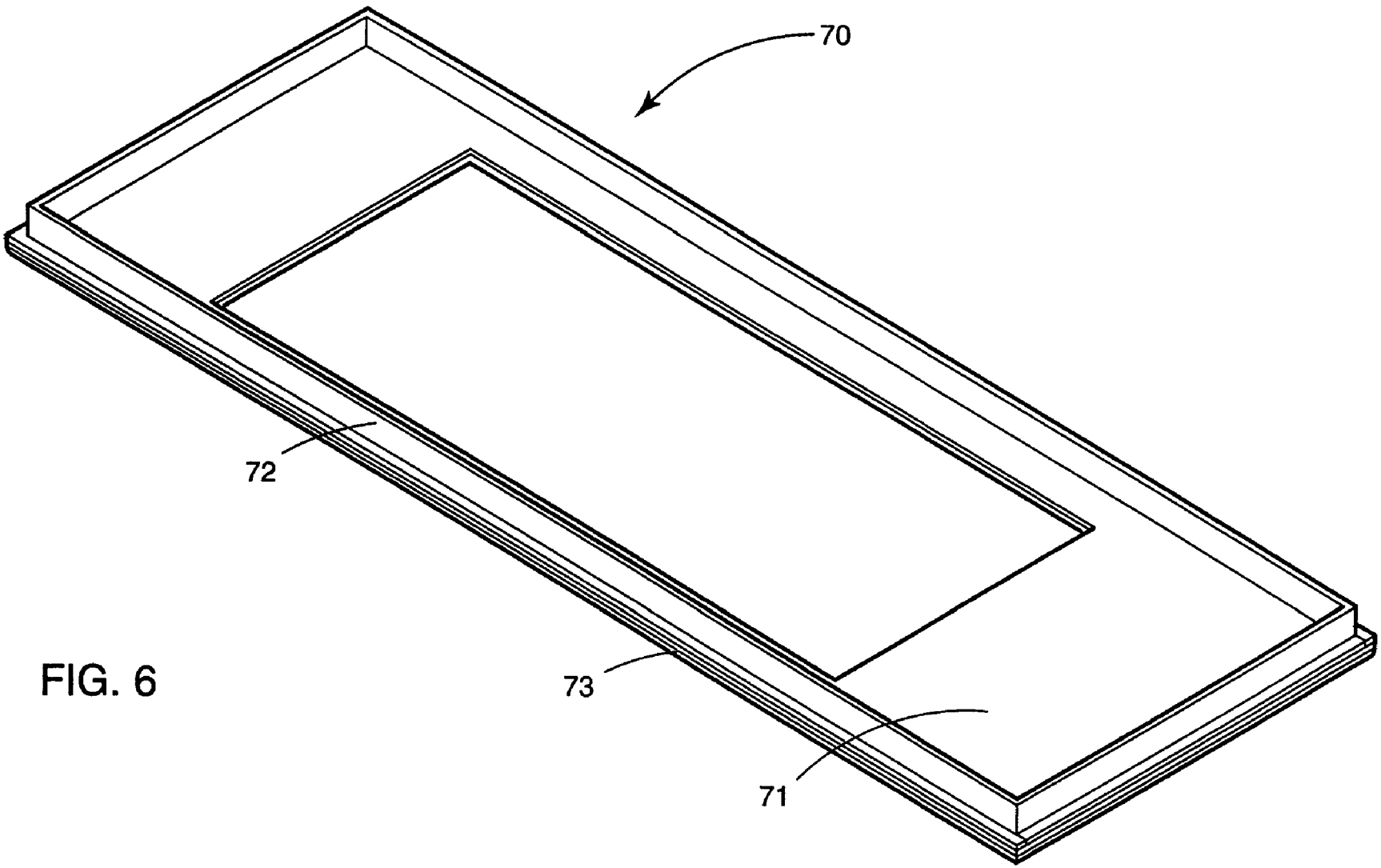
FIG. 6 is a bottom perspective view of the cover member of the divot simulator insert in accordance with the present invention.

Referring now to FIGS. 3 and 6, the cover member 70 consists of a cover plate 71, a frame member 72 and preferably a protective surface 73. The cover plate 71 is generally rectangular in shape and slightly larger in dimensions as the base member 40. The center portion is cut out to expose the simulated turf surface 60 and portions of the carriage extensions 53. The frame member 72, each segment having an inverted-L profile, extends down vertically from the underside along the circumference of the cover plate 71. When assembled, the frame member 72 fits snugly around the outer perimeter of the base member 40, and interlocks with the side and end frames 41, 42. The frame member 72 is removably attached to the base member 40 by any suitable conventional means such as screws, and is provided to strengthen the base member 40 and reduce or limit flexing when the device is in use. The flanges of the cover member 70 fit in the recessed spaces in the side walls of the cavity area 21 so that the divot simulator insert 30 can be fastened to the platform member 20 by any conventional means such as screws. In the preferred embodiment of the present invention, there is a protective surface 73 having the same dimensions as the cover plate 71 that is made of a resilient material and bonded to the top of the cover plate 71 by any suitable conventional means. The protective surface 73 is provided to help dissipate and absorb the impact force when the club head strikes the cover member 70 instead of the simulated turf surface 60 in the event of a missed hit.

In use, the golfer places a golf ball on the simulated turf surface 60 and takes a swing with a golf club. Referring to FIGS. 8-11, when the club head impacts the device, the force imparted to the carriage tray 51 compacts the forward compression springs 56 and moves the carriage tray 51, together with the simulated turf surface 60, forward as directed by the guide rails 55, thus simulating the feel to the golfer of striking a golf ball off natural turf and taking a divot. When the resistance from the forward compression springs 56 exceeds the forward force, the carriage tray 51 and the simulated turf surface 60 are then returned to their original position. Rearward compression springs 56 are employed to absorb the retraction force and reduce shock to the aft end of the device. The sliding forward of the carriage tray 51 and the simulated turf surface 60 also reduces club head bounce and lessens stress on the golfer's wrists and elbows, allowing the golfer to correctly practice his golf swing and decreasing risk of injury.

FIG. 1 illustrates a platform member 20 and divot simulator insert 30 configuration suitable for a right-handed golfer; however, the divot simulator insert 30 can be detached from the platform member 20, rotated 180° horizontally and reinstalled for use by a left-handed golfer.

To conclude, with respect to the above description, it is to be understood that the optimal dimensional specifications for the parts of the invention, including variations in number, size, shape, form, placement, material and the method of fabrication and assembly, are deemed readily apparent to persons skilled in the art upon a reading of the foregoing description, and all equivalent specifications to those illustrated in the drawings and detailed in the description are intended to be encompassed by the present invention.

Further, it will be obvious to those skilled in the art that various modifications and revisions can be made to the embodiment shown herein without departing from the spirit and essential characteristics of the invention. It is therefore intended by the appended claims to cover any and all such modifications and revisions within the scope of the present invention.

What is claimed is:

1. A golf practice device comprising:

a platform member for supporting the golfer; and a divot simulator insert installed in a cavity area within said platform member, said divot simulator insert having a hitting surface that yields and moves when impacted by the head of a golf club during a golf swing to simulate the response of natural turf wherein said divot simulator insert comprises:

a base member having a bottom panel, side frames along the length dimension on either side and end frames along the width dimension;

a carriage tray with upstanding edges on all sides and having at least on sleeve affixed to both sides along the length dimension and carriage extensions extending outward from the forward and the aft sides, said carriage tray slidably positioned on said base member;

a simulated turf surface affixed to said carriage tray;

a cover member having a cover plate and a frame member extending down vertically from the underside along the perimeter of said cover plate, said frame member fits snugly around the outer perimeter of said base member and interlocks with said side and end frames when assembled, and said cover plate having a center portion cut out to expose said simulated turf surface and portions of said carriage extensions; and a carriage retraction assembly arranged on both sides of said carriage tray along the length dimension and mounted on mounting brackets on said base member for controlling the sliding forward in the general direction of the ball flight and the retraction of said carriage tray and said simulated turf surface when said simulated turf surface is impacted by the head of a golf club striking a golf ball placed on said simulated turf surface.

2. The golf practice device of claim 1 wherein each said carriage retraction assembly further comprises a guide rail, one or multiple forward compression springs and a rearward compression spring, whereby said forward and rearward compression springs and said at least one sleeve of said carriage tray are fitted over said guide rail with said at least one sleeve being sandwiched between said forward compression springs and said rearward compression spring such that the movement of said carriage tray is controlled by said carriage retraction assembly.

3. The golf practice device of claim 1 wherein said base member has a low coefficient of friction with respect to the underside of said carriage tray.

4. The golf practice device of claim 1 wherein each said carriage retraction assembly further comprises a guide rail, and one or multiple forward compression springs, whereby said one or multiple forward compression springs and said at least one sleeve of said carriage tray are fitted over said guide rail with said one or multiple forward compression springs being forward of said at least one sleeve such that the movement of said carriage tray is controlled by said carriage retraction assembly.

5. The golf practice device of claim 4 wherein said carriage retraction assembly further comprises an energy absorbing element for limiting the retraction movement of the carriage tray.

6. The golf practice device of claim 5 wherein said energy absorbing element comprises one or multiple rearward compression springs on each of said guide rails rearward of said at least one sleeve.

7. A golf practice device comprising:

a platform member for supporting the golfer; and a divot simulator insert installed in a cavity area within said platform member, said divot simulator insert having a hitting surface that yields and moves when impacted by the head of a golf club during a golf swing to simulate the response of natural turf wherein said divot simulator insert comprises:

a base member;

a carriage tray on and longitudinally moveable with respect to the base member;

a simulated turf surface affixed to said carriage tray; and a carriage retraction assembly arranged proximate each of the longitudinal sides of said carriage tray, said carriage retraction assembly comprising on each side a spring element in contact with said carriage tray to cause retraction of said carriage tray after said carriage tray moves forwardly when said simulated turf surface is impacted by the head of a golf club striking a golf ball placed on said simulated turf surface.

8. The golf practice device of claim 7 wherein said carriage tray further comprises at least one sleeve affixed to each side of said carriage tray extending longitudinally thereof; and said carriage retraction assembly further comprising a guide rail on each side of said base member carrying said spring element thereon forward of said at least one sleeve, said guide rail extending through said at least one sleeve and said guide rail being mounted on said base member at ends thereof.

9. The golf practice device of claim 8 further comprising a second spring element on each side carried on said guide rail rearward of said at least one sleeve thereby to control retraction of said carriage tray as it is retracted by said spring element on each side.

10. The golf practice device of claim 9 wherein said guide rails are fixed at respective forward and rearward ends to said base member by mounting brackets.

11. The golf practice device of claim 8 wherein said carriage retraction assembly further comprises an energy absorbing element for limiting the retraction movement of the carriage tray.

12. The golf practice device of claim 11 wherein said energy absorbing element comprises one or multiple rearward compression springs on each of said guide rails rearward of said at least one sleeve.

13. The golf practice device of claim 7 wherein said carriage tray has end extensions extending from forward and aft ends thereof and further comprising a cover member having a cover plate and being supported on said base member and said cover plate having a center portion cut out to expose said simulated turf surface and portions of said end extensions.

14. A golf practice device comprising;

a divot simulator, said divot simulator having a hitting surface that yields and moves when impacted by the head of a golf club during a golf swing to simulate the response of natural turf, said divot simulator comprising;

a base member;

a carriage tray on and longitudinally moveable with respect to the base member and having at least one sliding member on each of longitudinal sides to slidingly engage a carriage retraction assembly on the base member;

a simulated turf surface affixed to said carriage tray; and a carriage retraction assembly supported on each of longitudinal sides of said base member comprising a support member attached to each side of said base member and being slidably engaged with said at least one sliding member on each of the longitudinal sides of the carriage tray for longitudinal movement of said carriage tray with respect to said base member, said carriage retraction assembly further comprising on each side a spring element in contact with said carriage tray for controlling forward movement of the carriage tray and to cause retraction of said carriage tray after said carriage tray moves forwardly when said simulated turf surface is impacted by the head of a golf club striking a golf ball placed on said simulated turf surface.

15. The golf practice device of claim 14 said support member attached to each side of the base member comprising a guide rail carrying said spring element thereon forward of said at least one sliding member, said guide rail extending through said at least one sliding member and said guide rail being mounted on said base member at ends thereof.

16. The golf practice device of claim 15 further comprising a second spring element on each side carried on said guide rail rearward of said at least one sliding member thereby to control retraction of said carriage tray as it is retracted by said spring element on each side.

17. The golf practice device of claim 16 wherein said guide rails are fixed at respective forward and rearward ends to said base member by mounting brackets.

18. The golf practice device of claim 15 wherein said carriage retraction assembly further comprises an energy absorbing element for limiting the retraction movement of the carriage tray.

19. The golf practice device of claim 18 wherein said energy absorbing element comprises one or multiple rearward compression springs on each of said guide rails rearward of said at least one sliding member.

20. The golf practice device of claim 14 wherein said carriage tray has end extensions extending from forward and aft ends thereof and further comprising a cover member having a cover plate and being supported on said base member and said cover plate having a center portion cut out to expose said simulated turf surface and portions of said end extensions.

21. A golf practice device comprising;

a divot simulator having a hitting surface that yields and moves when impacted by the head of a golf club during a golf swing to simulate the response of natural turf said divot simulator comprising;

a base member;

a carriage tray on and longitudinally moveable with respect to the base member having at least one sleeve on each of longitudinal sides to slidingly engage a carriage retraction assembly on the base member;

a simulated turf surface affixed to said carriage tray; and a carriage retraction assembly arranged on each of longitudinal sides of said base member comprising a guide rail attached to each side of said base member and being slidably engaged with said at least one sleeve on each of the longitudinal sides of the carriage tray for longitudinal movement of said carriage tray with respect to said base member, said carriage retraction assembly further comprising on each side one or multiple forward compression springs in contact with said carriage tray and being fitted over said guide rail with said one or multiple forward compression springs being forward of said at least one sleeve such that the movement of said carriage tray is controlled by said carriage retraction assembly to cause retraction of said carriage tray after said carriage tray moves forwardly when said simulated turf surface is impacted by the head of a golf club striking a golf ball placed on said simulated turf surface.

22. The golf practice device of claim 21 wherein said carriage retraction assembly further comprises an energy absorbing element for limiting the retraction movement of the carriage tray.

23. The golf practice device of claim 22 wherein said energy absorbing element comprises one or multiple rearward compression springs on each of said guide rails rearward of said at least one sleeve.

* * * * *